US009340322B2

(12) United States Patent
Harris

(10) Patent No.: US 9,340,322 B2
(45) Date of Patent: May 17, 2016

(54) TRANSPORT PALLET

(71) Applicant: Philip John Fox Harris, Fareham (GB)

(72) Inventor: Philip John Fox Harris, Fareham (GB)

( * ) Notice: Subject to any disclaimer, the term of this patent is extended or adjusted under 35 U.S.C. 154(b) by 0 days.

(21) Appl. No.: 14/480,737

(22) Filed: Sep. 9, 2014

(65) Prior Publication Data

US 2015/0158629 A1 Jun. 11, 2015

Related U.S. Application Data

(63) Continuation-in-part of application No. 13/103,068, filed on May 8, 2011, now Pat. No. 8,857,634.

(30) Foreign Application Priority Data

May 14, 2010 (GB) ..... 1008131.3

(51) Int. Cl.
*A47B 43/00* (2006.01)
*A47B 47/00* (2006.01)
(Continued)

(52) U.S. Cl.
CPC ..... *B65D 19/385* (2013.01); *A47B 47/021* (2013.01); *A47B 47/028* (2013.01); *A47B 87/0207* (2013.01); *A47B 87/0215* (2013.01);
(Continued)

(58) Field of Classification Search
CPC ..... A47B 87/0223; A47B 87/0246; A47B 87/0253; A47B 87/0276; A47B 87/02; A47B 87/00; A47B 43/00; A47B 87/0215; A47B 47/028; A47B 47/021; A47B 47/027; A47B 87/0207; A47B 96/14; A47B 96/1441; A47B 45/00; A47B 81/007; A47B 57/06; A47B 57/30; A47F 5/13; A47F 5/16; A47F 5/12; A47F 7/17; A47F 7/175; A47F 5/132; A47F 5/01; A47F 5/101; A47F 5/10; B65D 19/08; B65D 85/68; B65D 19/12; B65D 85/66; B65D 19/385; B65D 88/022; B65D 88/129; B65D 88/522; B65D 19/44; B65D 21/0215; B65D 5/5033; B65D 5/006; B65D 5/0065; B65D 71/0096; B65D 57/00; B65D 25/10; B65D 85/48; B65D 19/004; B65D 19/00; B65D 21/00; B65D 21/02; B65D 21/0201; B65D 21/0209; B65D 2519/00024; B65D 2519/00059; B65D 2519/00233; B65D 2519/00164; B65D 2519/00298; B65D 21/0217; B65D 21/0226; B65D 71/70
USPC ..... 211/192, 175, 188, 194, 180, 191, 189; 108/53.1, 56.3, 56.1, 51.11; 312/265.1–265.5; 206/386, 509, 335, 206/586, 600, 505, 503, 504, 507
See application file for complete search history.

(56) References Cited

U.S. PATENT DOCUMENTS 2,833,421 A * 5/1958 Skubic ..... 211/194
3,809,234 A * 5/1974 Kurick ..... 206/448
(Continued)

*Primary Examiner* — Jennifer E Novosad
(74) *Attorney, Agent, or Firm* — Jennifer Meredith, Esq.; Meredith & Keyhani, PLLC

(57) ABSTRACT

A transport pallet comprising a chassis for supporting goods to be transported, and having feet extending below the chassis for supporting the chassis with a lifting fork space beneath the chassis. The pallet also includes legs provided around the perimeter of the chassis. The legs enable the pallets to be stacked one on another, and have a hollow upper portion and/or a hollow lower portion. Leg extensions are also provided for fitting into the hollow legs to provide separation between the chassis of the stacked pallets. These can be height adjusted. The pallets are generally made of steel or aluminum but can also be made of plastics material having a metal center.

13 Claims, 17 Drawing Sheets

(51) Int. Cl.

| | |
|---|---|
| ***A47B 57/00*** | (2006.01) |
| ***B65D 19/08*** | (2006.01) |
| ***B65D 88/02*** | (2006.01) |
| ***A47B 87/02*** | (2006.01) |
| ***A47B 47/02*** | (2006.01) |
| ***B65D 19/18*** | (2006.01) |
| ***B65D 19/38*** | (2006.01) |
| ***B65D 19/44*** | (2006.01) |

(52) U.S. Cl.

CPC ..... *B65D 19/44* (2013.01); *B65D 2519/00024* (2013.01); *B65D 2519/00034* (2013.01); *B65D 2519/00044* (2013.01); *B65D 2519/00059* (2013.01); *B65D 2519/00069* (2013.01); *B65D 2519/00079* (2013.01); *B65D 2519/0084* (2013.01); *B65D 2519/0096* (2013.01); *B65D 2519/0097* (2013.01); *B65D 2519/00233* (2013.01); *B65D 2519/00273* (2013.01); *B65D 2519/00293* (2013.01); *B65D 2519/00298* (2013.01); *B65D 2519/00308* (2013.01); *B65D 2519/00323* (2013.01); *B65D 2519/00333* (2013.01); *B65D 2519/00338* (2013.01); *B65D 2519/00373* (2013.01); *B65D 2519/00532* (2013.01); *B65D 2519/00562* (2013.01); *B65D 2519/00676* (2013.01); *B65D 2519/00696* (2013.01); *B65D 2519/00701* (2013.01); *B65D 2519/00815* (2013.01)

(56) References Cited

U.S. PATENT DOCUMENTS

| | | | | | |
|---|---|---|---|---|---|
| 4,673,092 | A * | 6/1987 | Lamson et al. | 211/188 |
| 4,703,702 | A * | 11/1987 | Speicher | 108/56.3 |
| 4,773,547 | A * | 9/1988 | Bell | 211/194 |
| 4,934,538 | A * | 6/1990 | Beyer | 211/49.1 |
| 5,145,073 | A * | 9/1992 | Kitagawa et al. | 211/41.14 |
| 5,154,310 | A * | 10/1992 | Massey | 206/505 |
| 5,692,625 | A * | 12/1997 | Filipescu et al. | 211/195 |
| 6,213,315 | B1 * | 4/2001 | Forney et al. | 211/85.15 |
| 6,279,763 | B1 * | 8/2001 | Bush | 211/195 |
| 6,666,573 | B2 * | 12/2003 | Grassi | 366/26 |
| 6,726,041 | B2 * | 4/2004 | Dunn | 211/194 |
| 7,014,402 | B2 * | 3/2006 | Kessler | 410/155 |
| 7,066,342 | B2 * | 6/2006 | Baechle et al. | 211/191 |
| 7,137,517 | B2 * | 11/2006 | Lowry et al. | 211/188 |
| 7,878,340 | B1 * | 2/2011 | Olsen | 211/74 |
| 7,967,157 | B2 * | 6/2011 | Bilotto | 211/194 |
| 7,997,213 | B1 * | 8/2011 | Gauthier et al. | 108/55.1 |
| 8,002,128 | B2 * | 8/2011 | Kern et al. | 211/194 |
| 8,210,374 | B2 * | 7/2012 | Harpole | 211/195 |
| 8,297,452 | B2 * | 10/2012 | Anscomb et al. | 211/189 |
| 8,857,634 | B2 * | 10/2014 | Harris | 211/194 |
| 2002/0088763 | A1 * | 7/2002 | Flores | 211/85.22 |
| 2003/0183590 | A1 * | 10/2003 | Chubb | 211/41.14 |
| 2004/0140275 | A1 * | 7/2004 | Jeskey et al. | 211/41.14 |
| 2004/0245200 | A1 * | 12/2004 | Jersey et al. | 211/189 |
| 2006/0091096 | A1 * | 5/2006 | Velez et al. | 211/194 |
| 2007/0062899 | A1 * | 3/2007 | Royalty | 211/194 |
| 2007/0095775 | A1 * | 5/2007 | Beck | 211/194 |
| 2007/0119808 | A1 * | 5/2007 | Wishart et al. | 211/189 |
| 2008/0237225 | A1 * | 10/2008 | Owen | 220/1.5 |

* cited by examiner

TRANSPORT PALLET

The present invention relates to a transport pallet.

In my previous application filed under European patent application No. 09010923.2, dated 26 Aug. 2009, I described a transport pallet particularly through not exclusively for the transportation of corner boards.

This pallet has many advantages over standard wooden pallets, including the ability to stack one on another. The pallets are provided with feet and complementary cups either on the surface of the pallet or provided on corner posts, which distance one pallet from another, for stacking. This is very useful for moving numbers of empty pallets around, or for the stacking two pallets bearing corner boards or other extremely light goods. However, for stacking pallets with heavier goods, the system is not sufficiently supported, and could lead to collapse of the pallets and loss of the goods.

The wooden pallet was developed in approximately 1970, and before then all goods imported into the UK were imported "loose". However, the demand for wooden pallets immediately soared and they are now ubiquitous. One disadvantage of the standard wooden pallet is that it does not last very long, sometimes failing after a single journey. The constant replacement of these pallets provides a large requirement for wood for the manufacture of the same, causing damage to the rainforests, and other non-sustainable sources of wood.

Another disadvantage of the standard wooden pallet is that it does not allow for stacking. It is of course possible to pile one pallet loaded with goods on top of another pallet loaded with goods, the upper pallet resting on the goods on the first pallet. This results in the pallet and the goods at the bottom on the stack bearing all of the weight of the pallet and goods at the top of the stack. This weight can cause damage to the goods and pallets.

The object of the present invention is to provide an improved transport pallet.

According to the invention there is provided a transport pallet comprising: a first chassis, the chassis having an outer perimeter defining within a pallet sized load bearing platform for a pallet; a plurality of feet extending below the chassis for supporting the first chassis on the ground with a lifting fork space beneath the first chassis, wherein at least a portion of said plurality of feet are within the outer parameter of the first chassis; and a plurality of legs attached to the first chassis outside the outer perimeter of the chassis and the pallet, the legs extending substantially vertically from the ground level, the legs providing further stability to the first chassis when on the ground. The legs having upper portions above the first chassis and provided in pairs at respective opposite sides of the pallet sized load-bearing platform; and a corresponding plurality of leg extension posts extending above the upper portions of the legs.

Typically, the leg extension posts are sized to fit into the upper portions of the plurality of legs, attached to the first chassis.

Ideally, the feet and legs have closed lower ends for spreading the load on the ground, thus avoiding damage to a support surface.

Usually the transport pallet will be provided as a pair of chassis to be stacked including; a second chassis having; an outer perimeter defining within it a pallet sized load-bearing platform for a pallet; a plurality of feet extending below the second chassis for supporting the second chassis on the ground, when separated from the leg extension posts, with a lifting fork space beneath the chassis, wherein at least a portion of said plurality of feet are within the outer perimeter of the second chassis; and a plurality of legs provided outside the perimeter of the chassis and attached thereto, the legs; extending substantially vertically from ground level, when separated from the leg extension posts providing further stability to the chassis when on the ground and being open ended for receiving the leg extension posts.

Alternatively the second chassis can have: an outer chassis having defining within it a pallet sized load-bearing platform for a pallet wherein the perimeter is defined by a rectangular frame and the feet comprise short legs extending below the frame and interconnected by strips at their lower a plurality of feet extending below the second chassis for supporting the second chassis on the ground, when separated from the leg extension posts, within a lifting fork space beneath the chassis, wherein a portion of said plurality of feet are within the outer perimeter of the second chassis; and a plurality of sockets provided outside the perimeter of the chassis and attached thereto, the sockets being open ended for receiving the leg extension posts.

Typically, the short legs provided at the corners of the rectangular frame are angled inwards.

The rectangular frame may also include a deck supported within its periphery.

The transport pallet can be provided with a third chassis the same as or similar to the second chassis with its legs/sockets receiving the leg extension posts.

A transport pallet may also include a pair of narrow frames, comprising: a pair of sockets provided at the opposite ends of the narrow frames, the sockets being open ended for receiving the leg extension posts.

Typically, including pallet sized deck, the narrow frames and the deck having complementary formations for support of the deck on the frames above the first chassis.

Ideally, the narrow frames have upwardly projection serrations for locating a pallet on them by frictional indentation.

Usually the leg extensions will include a means for adjusting the distance between the two chassis.

Preferably, the upper portions of the legs are provided with at least one cross member provided between the pair legs at respective sides of the first chassis.

While upper and lower pallets can be identical, preferably the lower pallets are made of steel while upper pallets are made of aluminium or plastics material, typically reinforced. In addition the construction of the chassis may be different. Typically lower pallets will have feet in the form of posts extending downwards from the corners, while upper pallets will have feet in the form of inverted cups extending from below the chassis. Alternatively, further simplified chassis may be provided as upper chassis.

Preferably, the pair or set of stacked pallets includes means for adjusting the distance between the two chassis.

Usually the pallet will be constructed of aluminium or steel, although it could be made from any strong material, typically metal or reinforced plastics.

Preferably the legs will be provided in pairs on opposing sides of the chassis, with cross members provided between the pairs to increase stability of the stacked pallets. Typically two pairs of legs will be provided per chassis, although four pairs could also be provided.

Conveniently, the chassis may be provided with interior space to store the leg extensions when not in use.

Typically the chassis will also be provided with gripper rods having teeth to increase friction and assist in holding goods securely on the pallet. The pallet may additionally or alternatively be provided with a straps for strapping goods to the pallet. The strap may also be stored in interior space in the chassis when not in use. The chassis may also be provided with a grill defining interior space, and for providing attachment points for straps and the like.

According to a second aspect of the invention there is provided a pallet comprising a plastic coated metal frame, having at least one friction increasing element on an upper surface of at least one side, and having feet extending from beneath the frame to support the frame off the ground and provide a lifting fork space beneath the frame.

The frame may be made from steel, aluminium or any other strong resilient material. Typically the chassis is made from injection moulded plastics material encasing a metal framework. The provision of a metal core makes the plastics stronger and more durable. Typically the metal frame will be less than one fifth of the chassis construction. This enables the pallet to be provided at a weight similar to that of a standard wooden pallet. If the plastic coating gets damaged, it may be stripped off and the metal may be re-coated, extending the life of the pallet.

The friction increasing elements are typically provided a short length of teeth. The may be provided an upper surface of each side of the frame, but are usually provided on two opposing sides.

The frame will include edge members, and may also include cross-members increasing the contact surface between the frame and the goods stacked thereon.

To help understanding of the invention, various embodiments will now be described by way of example and with reference to the accompanying drawings, in which.

Figure 8:
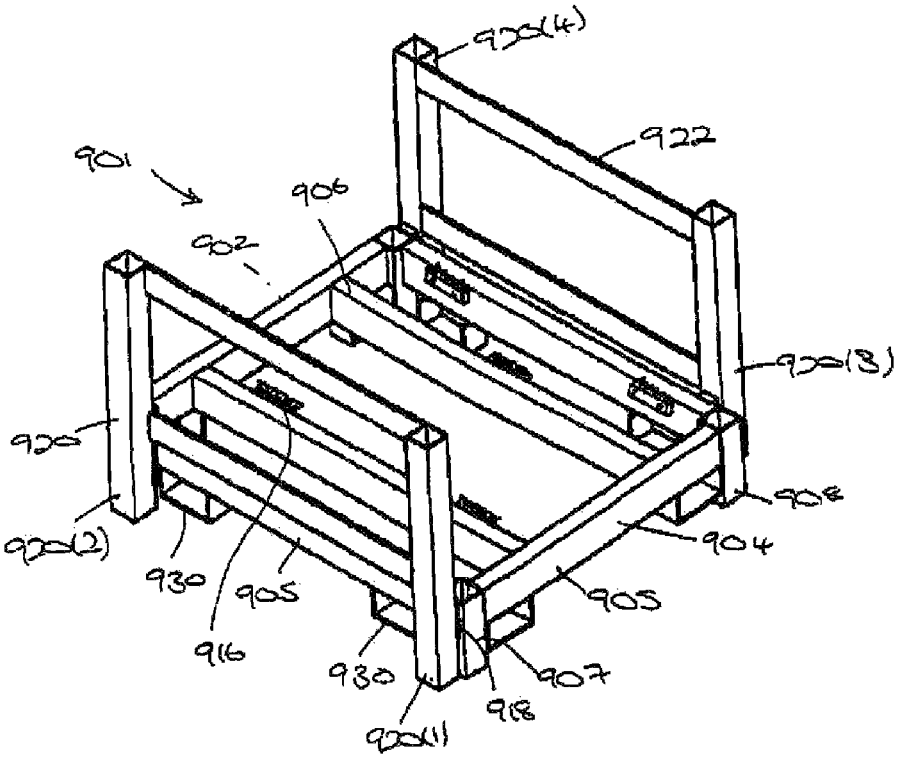
FIG. 8 is a perspective view of a pallet according to a fourth aspect of the invention.
Figure 9:
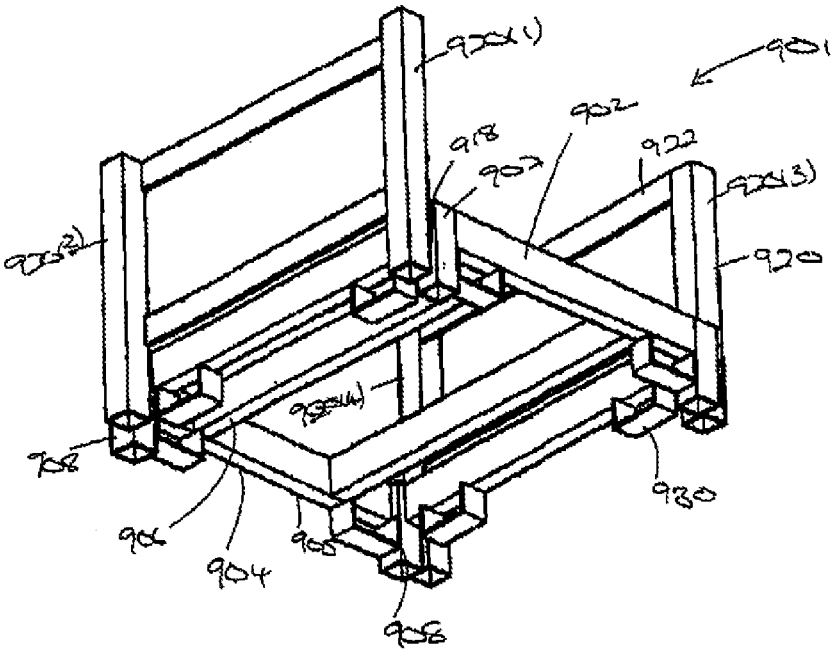
Figure 10:
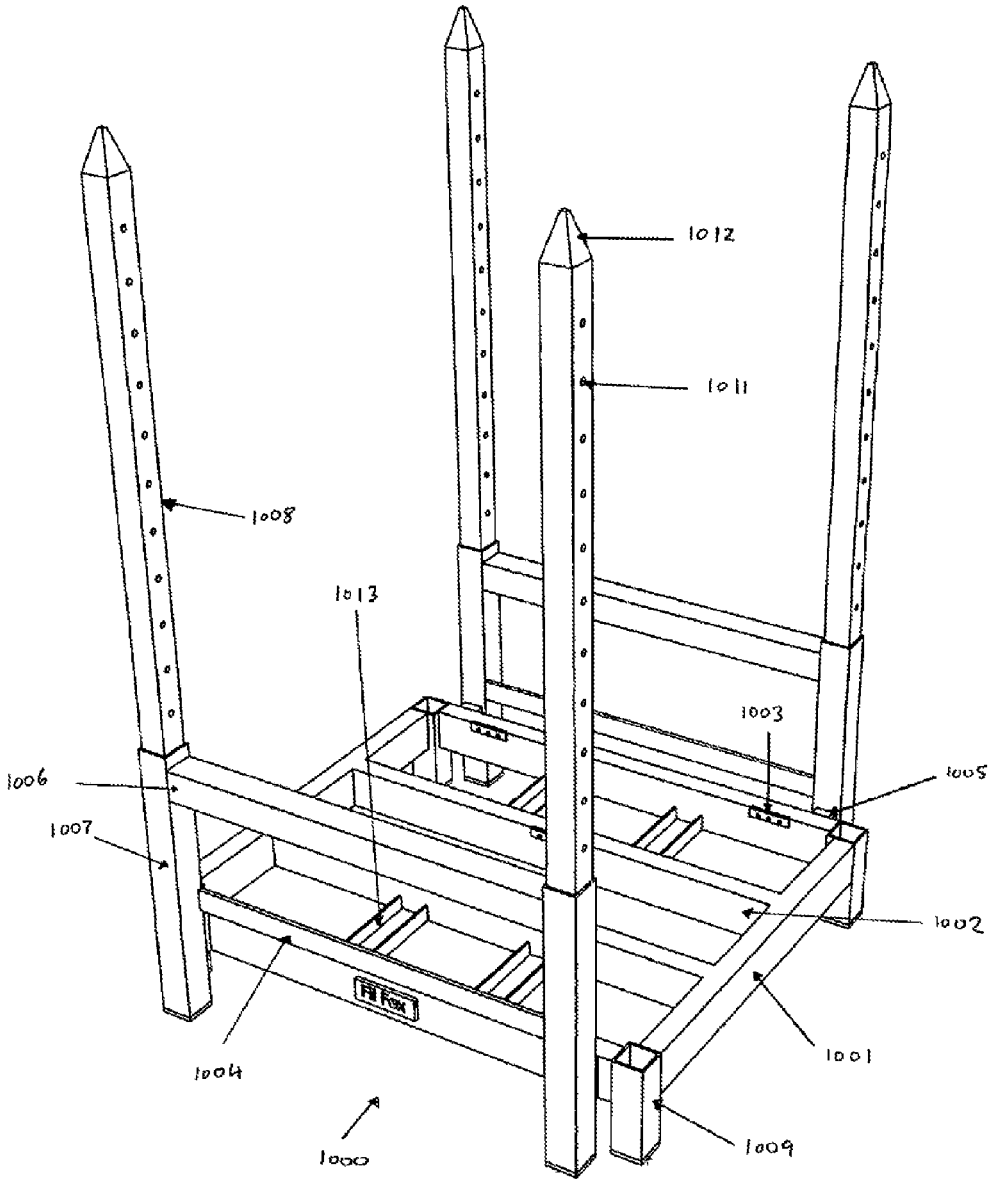
Figure 11:
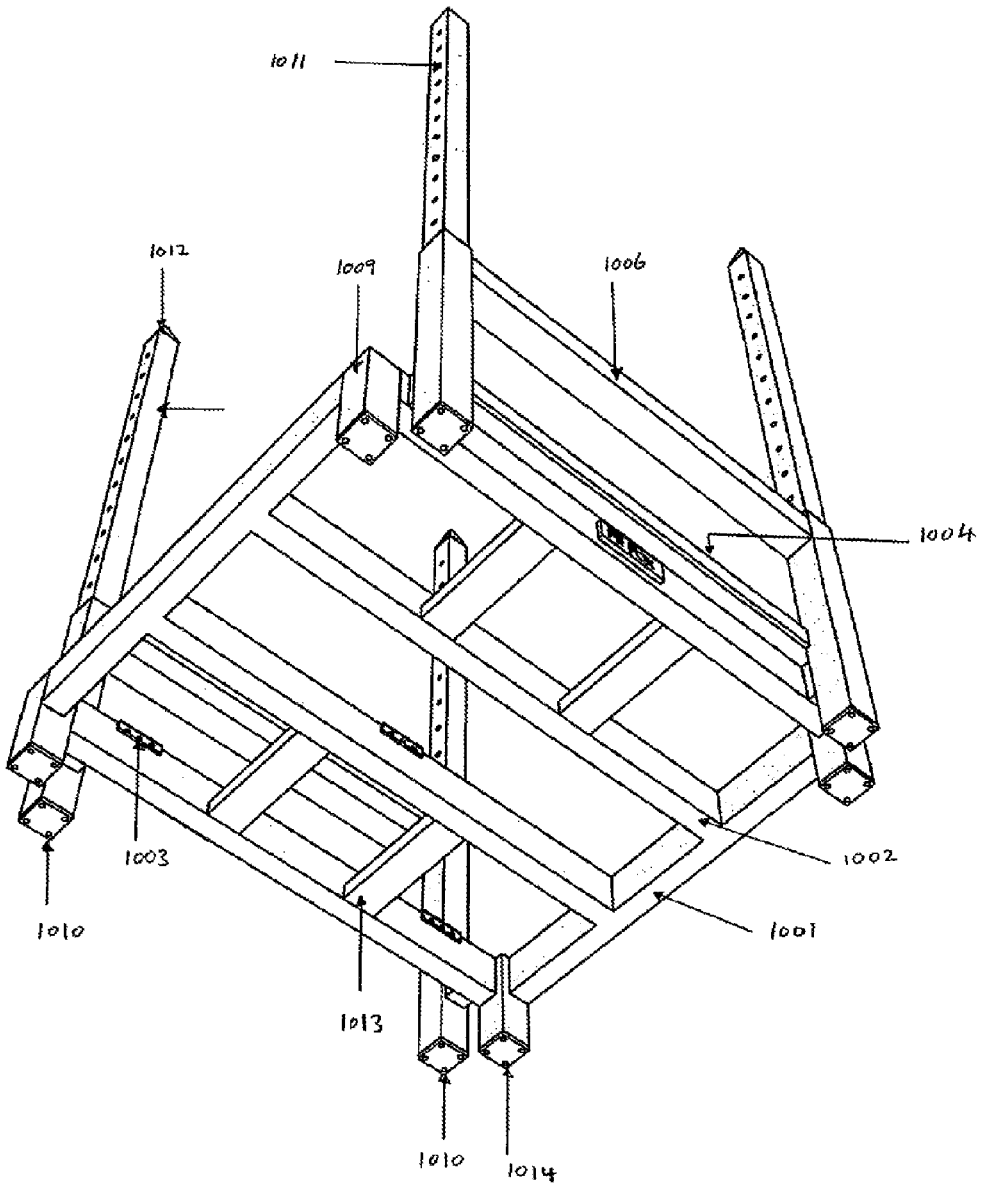
Figure 12:
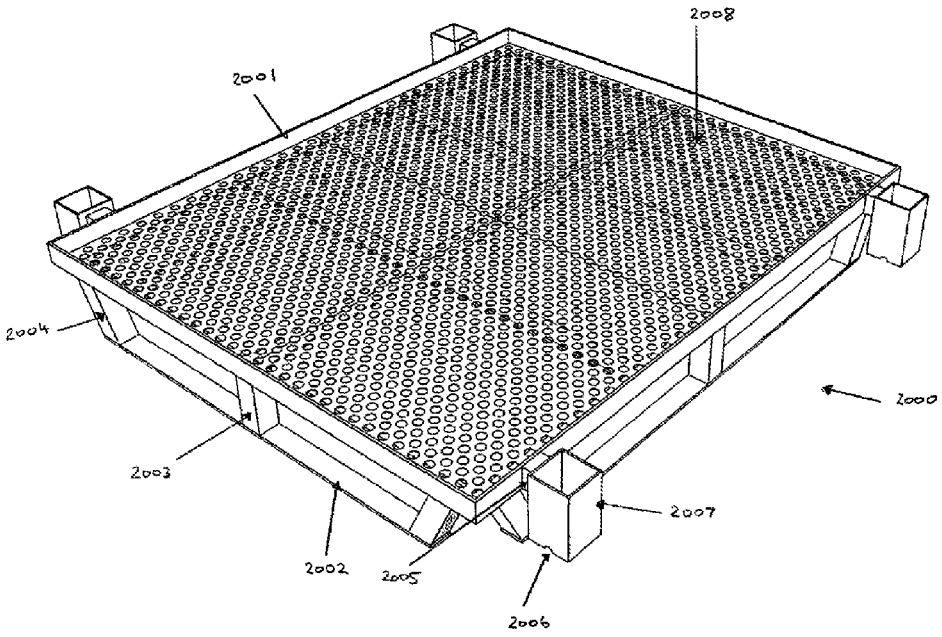
Figure 13:
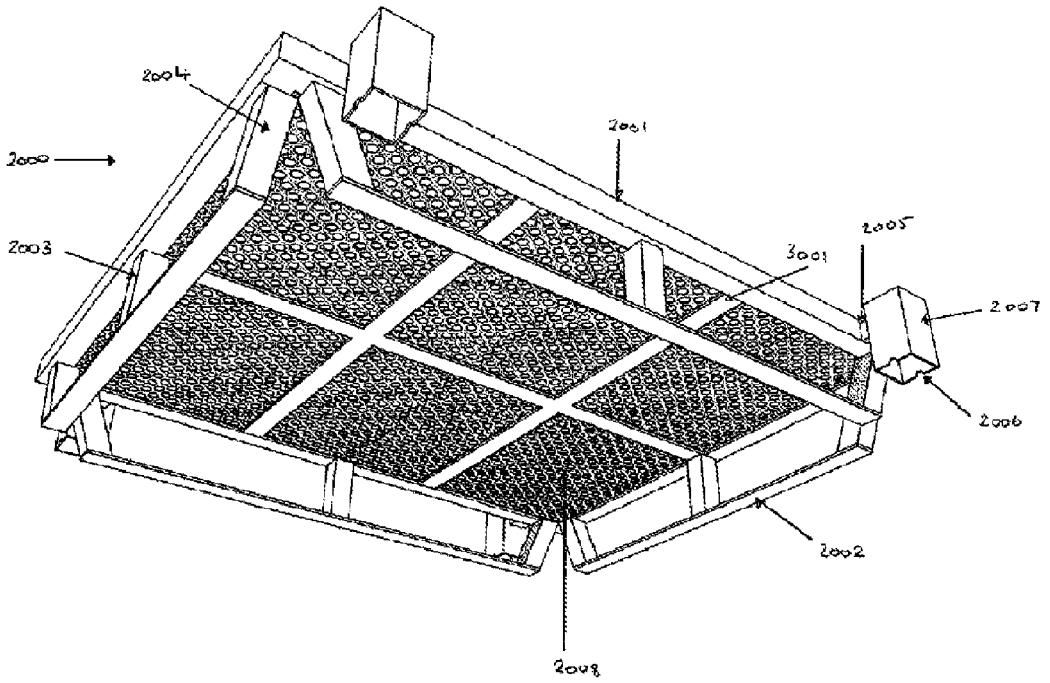
Figure 14:
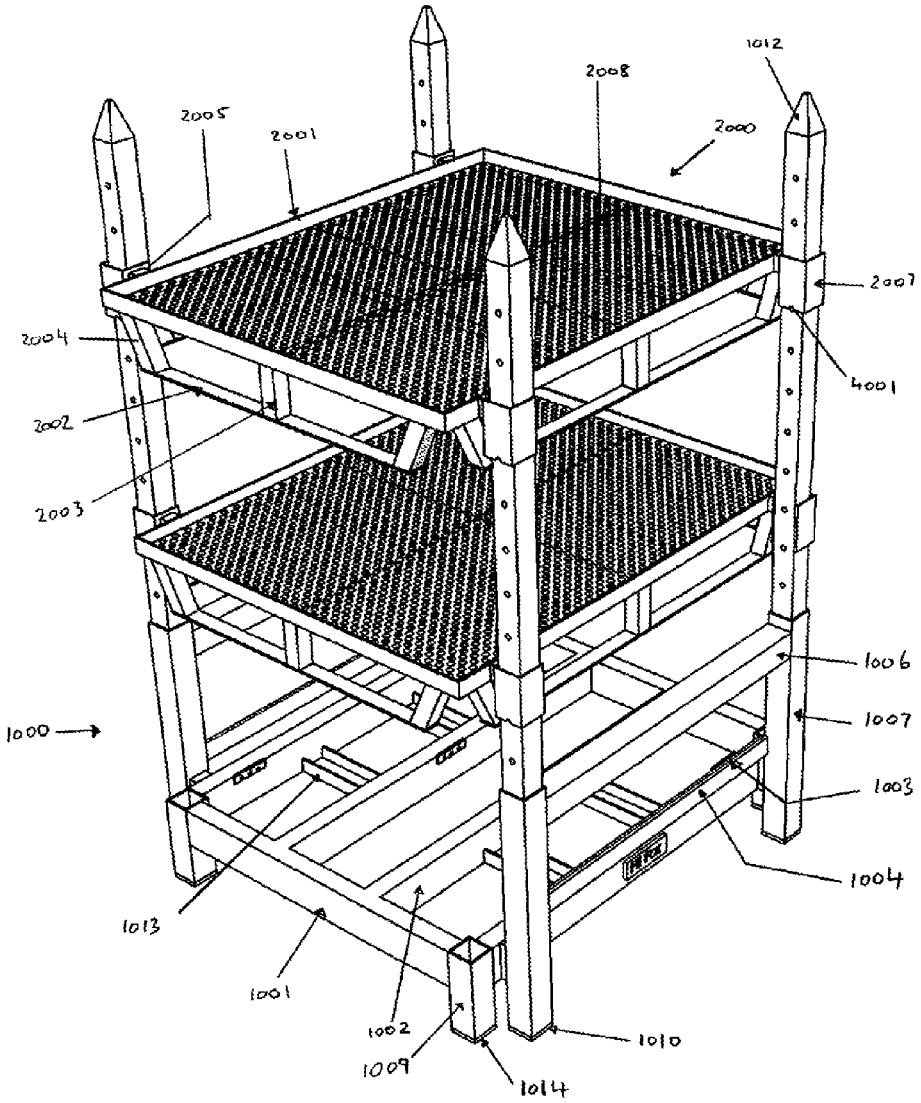
Figure 15:
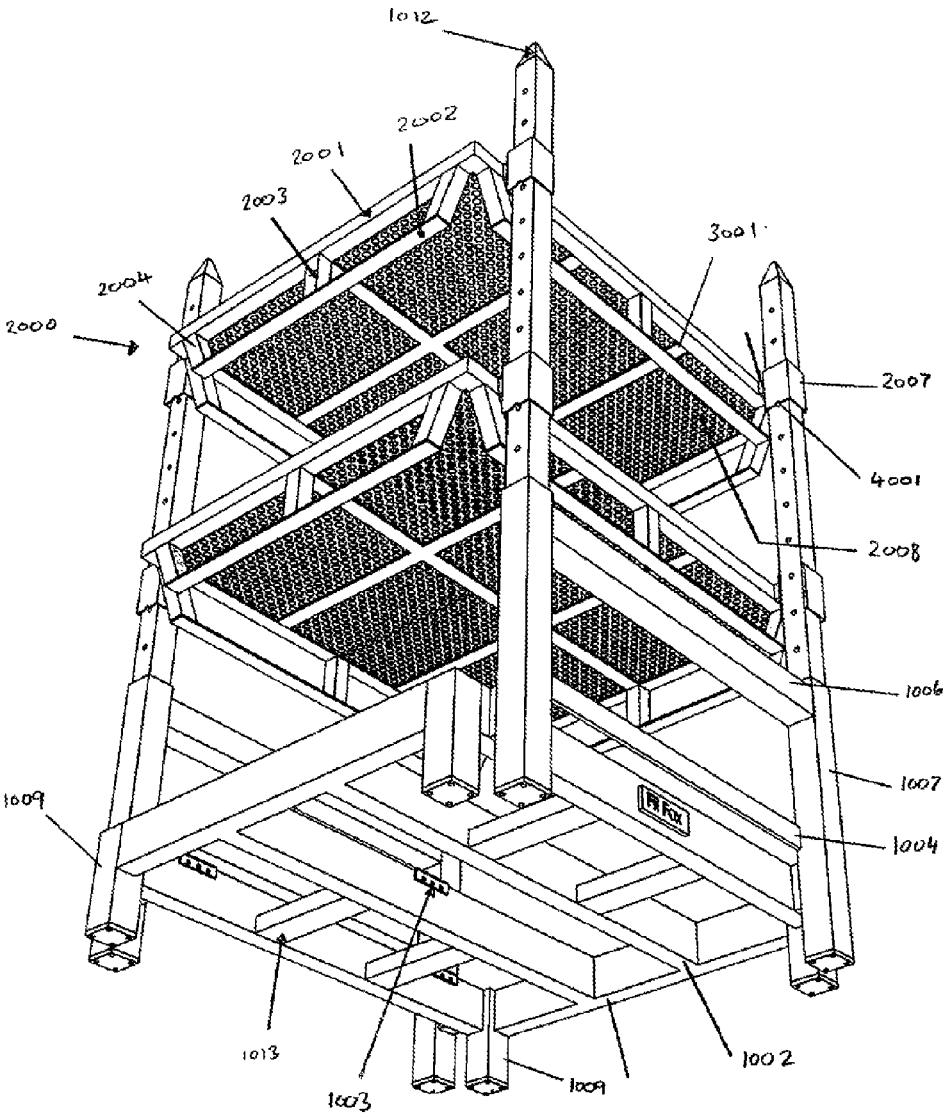
Figure 16:
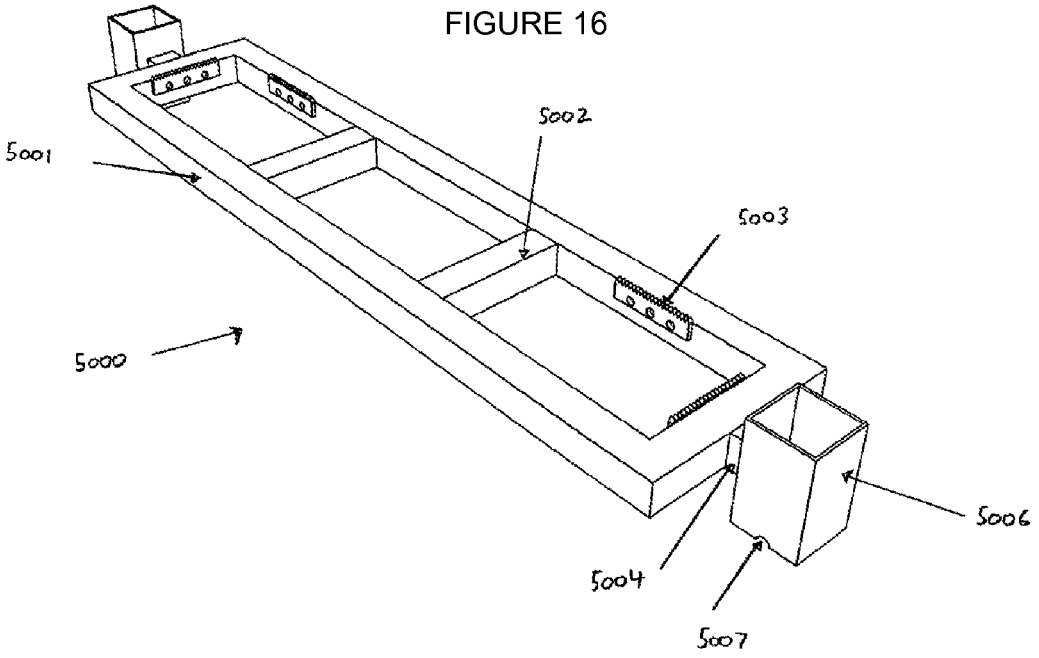
Figure 17:
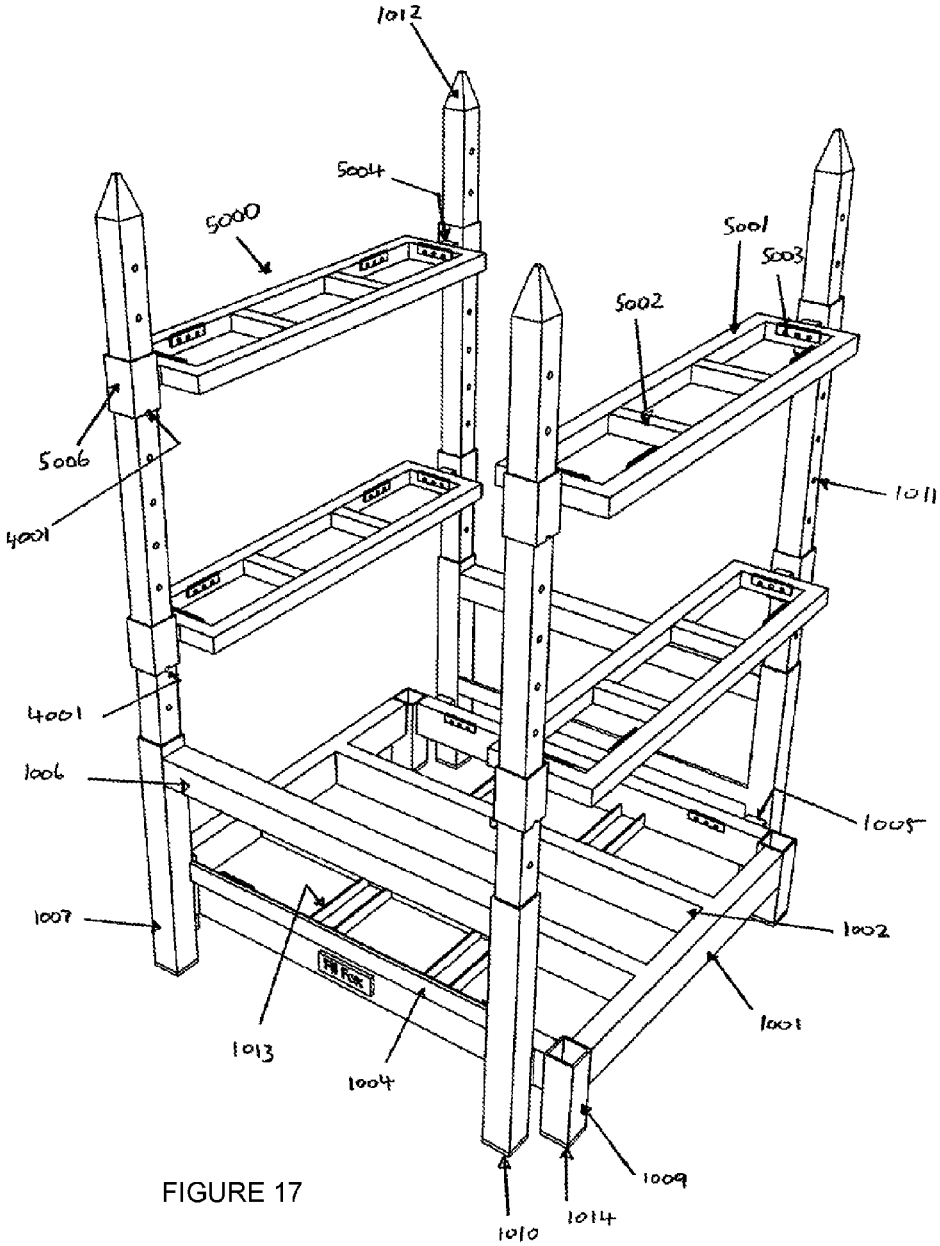

FIG. 9 an alternative perspective view of the patent of the pallet of FIG. 8;

FIG. 10 is a perspective view of the transport pallet system comprising chassis 1000;

FIG. 11 is a perspective view of the transport pallet system comprising chassis 1000 highlighting the underside;

FIG. 12 is perspective view of chassis 2000;

FIG. 13 is perspective view of chassis 2000 highlighting the underside;

FIG. 14 is a perspective view of a transport pallet system comprising chassis 1000 and 2000;

FIG. 15 is a perspective view of a transport pallet system comprising chassis 1000 and 2000 highlighting the underside;

FIG. 16 is a perspective view of chassis 5000;

FIG. 17 is a perspective view of a transport pallet system comprising chassis 1000 and 2000.

Figure 1:
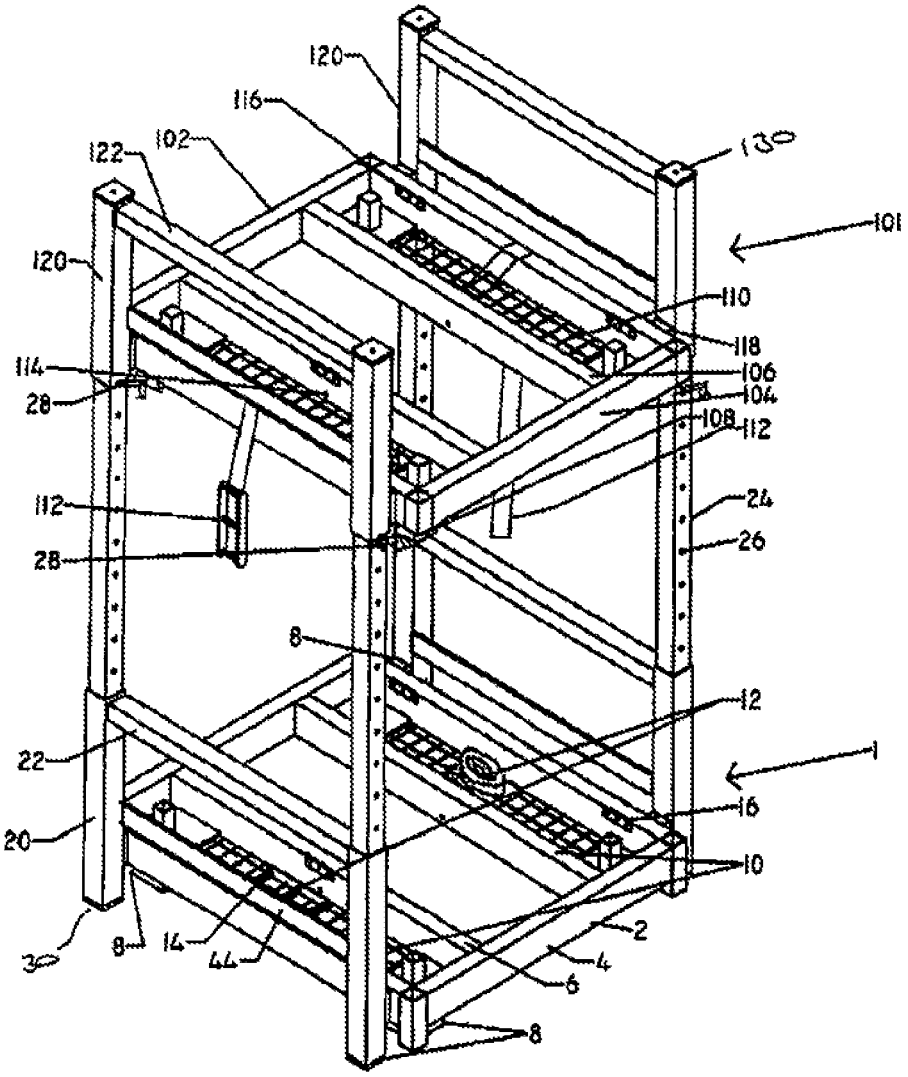
FIG. 1 is a perspective view of a pair of stacked pallets.
Figure 2:
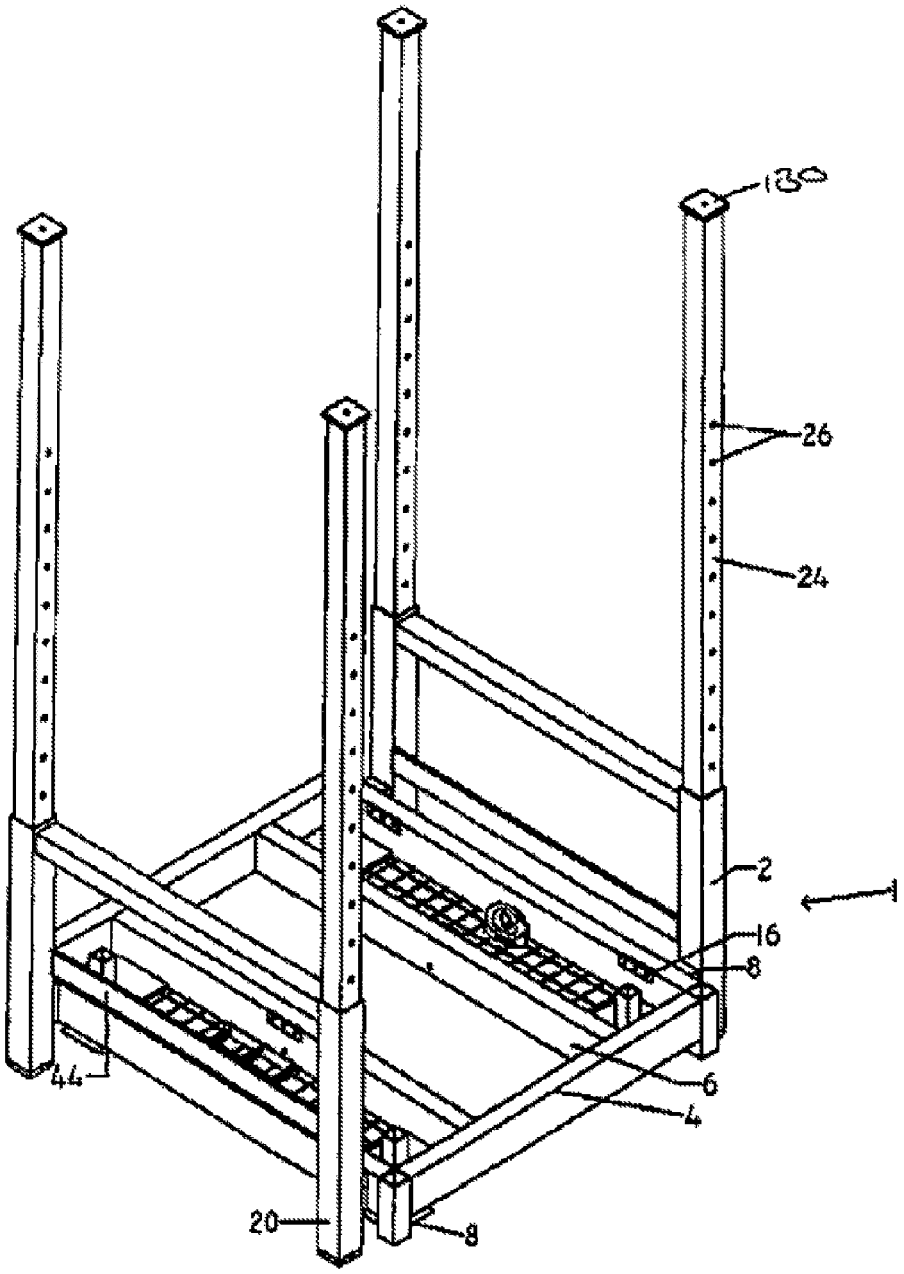
FIG. 2 is a perspective view of the lower pallet of FIG. 1 with stabiliser leg extensions.

Referring to FIGS. 1 and 2 of the drawings, the transport pallet system thereshown, comprises two pallets 1, 101 stacked one above the other.

Each pallet comprises a chassis, 2, 102, each having a frame work of box steel. The perimeter of each chassis defines a load bearing platform onto which goods can be placed. While the pallets will generally be made of steel or aluminium, they can be made of any strong material, including plastics materials which may be reinforced, for example with a metal core.

The chassis 1, 101, comprise an outer frame 4, 104 provided with additional strengthening cross members 6, 106. Any number of cross-members may be provided and together the outer frame and cross-members provide a platform on which goods can be placed. The chassis are also provided with feet, 8, 108, extending below the chassis to leave a fork lift gap to enable the pallet to be moved when required.

Positioned between the cross-members are holding trays 10, 110, provided with a grill base. Within the trays 10, 110, straps are provided 12, 112, for securing goods to the pallets. These generally comprise a strap and a ratchet for tightening and securing the strap. However, simple straps, with or without a buckle or other fastening means, can also be provided. While the straps can be attached to the grills, the chassis as shown are provided with additional anchors 14, 114 for the straps. Gripper rods 16, 116 are attached to the chassis at various positions, with their teeth slightly protruding above the surface of the chassis to provide additional frictional grip for any goods placed on the chassis. All these features are optional, but do increase the usefulness of the pallets.

Separated from the chassis by spacers 18, 118, are positioned legs 20, 120. These are positioned adjacent each corner of the chassis for maximum support. However, in other embodiments they could be positioned between the corners. As shown, the legs are provided in pairs, with a strengthening cross-members 22, 122 provided between each pair. These stabilise the pairs of legs. The legs are provided as hollow box-section lengths. As shown the cross-members 22, 122 are also provided as hollow box-section lengths, although these could also be provided as flat bars. The legs extend below the chassis to the same extent at the chassis feet, resulting in a stable support for the chassis. As shown four legs are provided in two pairs. However, four pairs of legs could also be provided. In an important preferred feature, the legs are off-set from each other on opposite sides, enabling interlocking of the legs, thus saving space, but also stabilising the pallet stacks together.

Referring to FIG. 2, the pallet thereshown is the lower pallet of the stack of FIG. 1, provided with leg extension post 24 provided in each leg. These are sized to fit inside the hollow legs, 20.

Referring back to FIG. 1, a second pallet 101 is shown stacked above the first pallet 1. The legs 120 of the second pallet have been fitted over the leg extension posts 24. The leg extension posts 24 are provided with a series of apertures 26 along their length, into which drop nose pins 28 can be positioned, to prevent the second pallet from sliding fully down the posts. This enables the distance between the two pallets to be set to any desired distance. Although the system including the apertures and drop nose pins is shown in FIG. 1, other methods of setting the distance between the pallets, on the legs could be used, for example a ratchet system, or fixed length posts 24, for goods and sets of goods of set sizes. The system shown in the FIGS. 1-3 is generally preferred being straightforward.

In the upper pallet 101, the legs 120 are provided with a top plate 130, which limits the extent to which the leg extension post 28 can pass through the leg 120. The plate is bolted to the top of the leg providing an additional stop in the event that the pins 28 are not in position, or in the event of a failure of a pin. These top plates 130 are removable and can be used at the top of the legs 120 or the leg extension posts 24.

Similarly in the lower pallet 1, the legs 20 are provided with bottom plates 30 that prevent the leg extensions 24 from extending through the legs of the lower pallet. However, generally a single pallet will be moved at a time, rather than a stack, and therefore the lower plate 30 is not required to support the weight of the upper pallet and its contents away from the floor. Typically the top 130 and bottom plates 30 will be removable so that pallets can be used as either top or bottom pallets.

Figure 3:
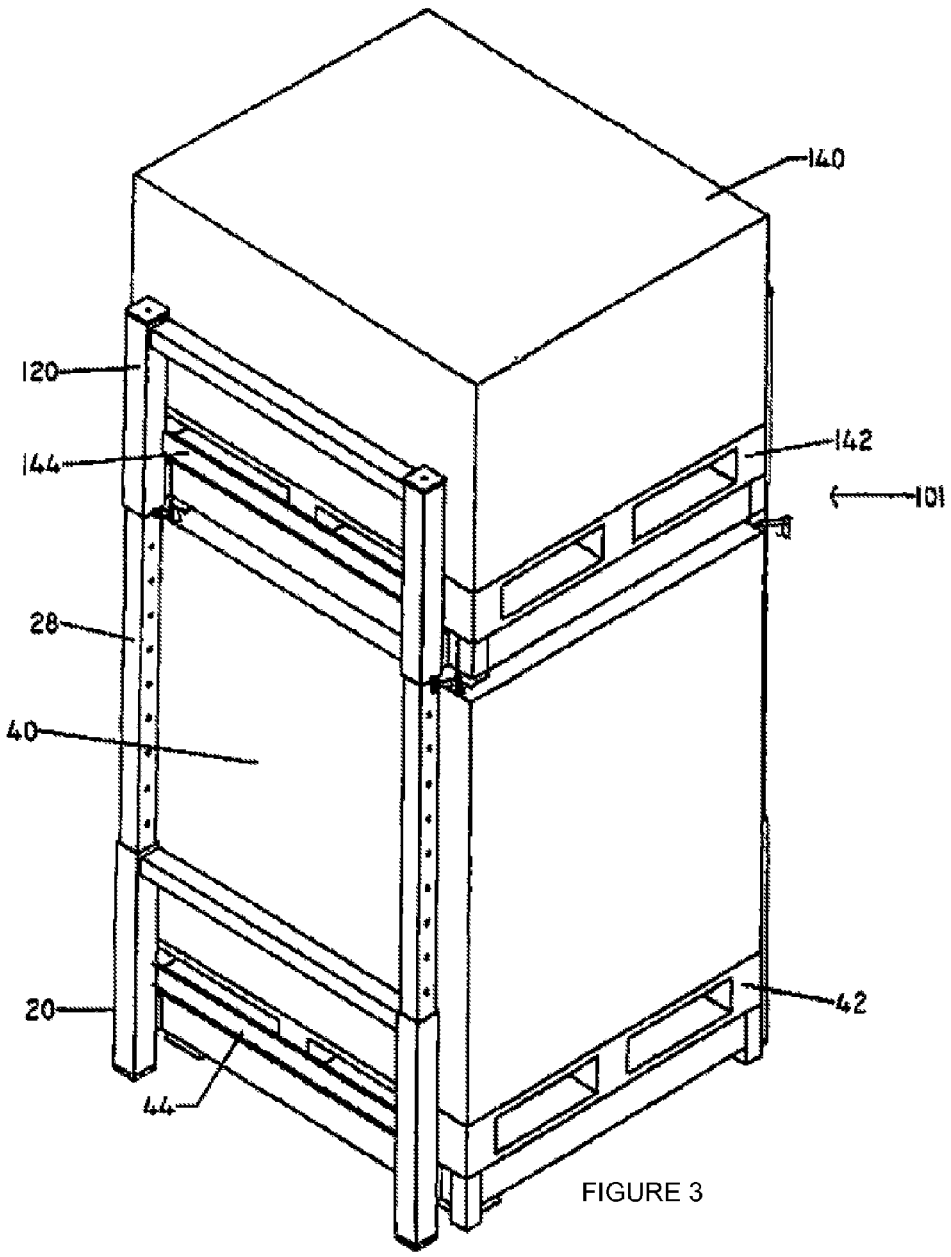
FIG. 3 is a perspective view of the pair of stacked pallets of FIG. 1 loaded with goods.
Figure 4:
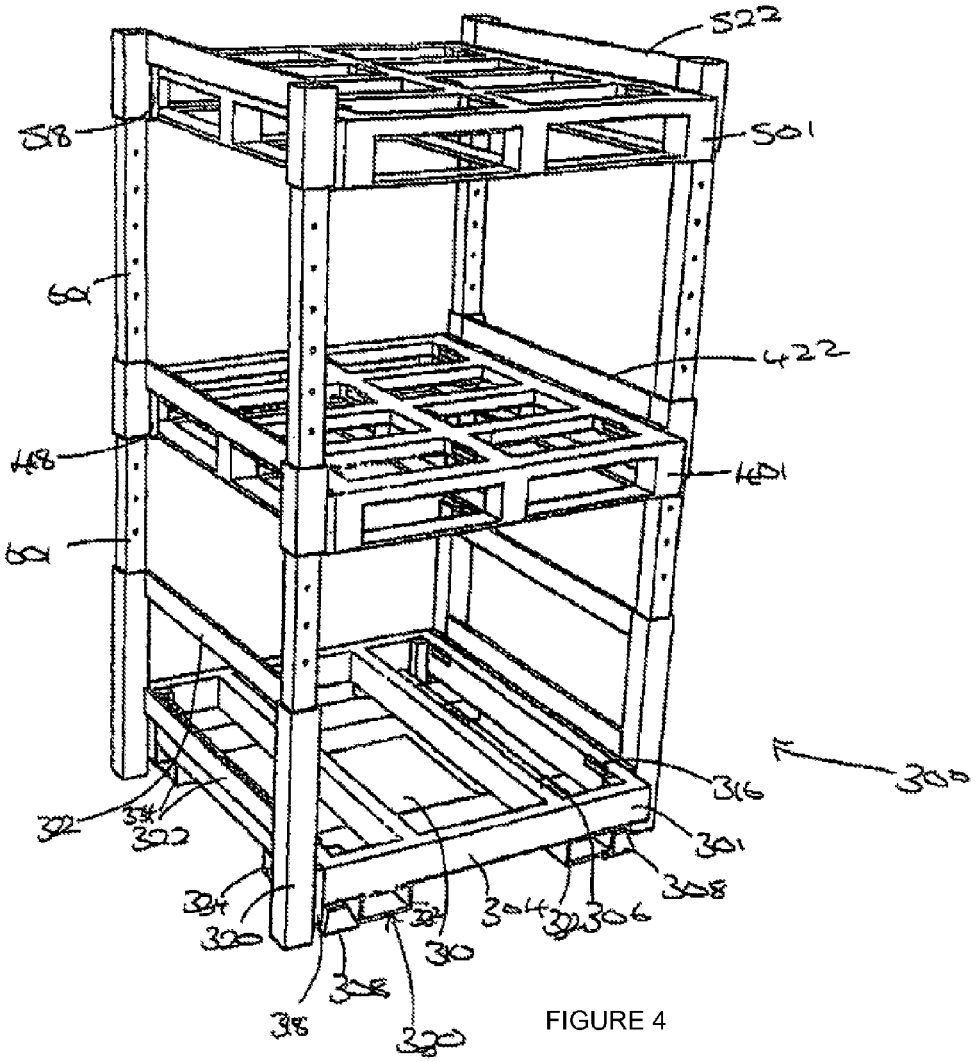
FIG. 4 is a perspective view of a triple stack of pallets.
Figure 5:
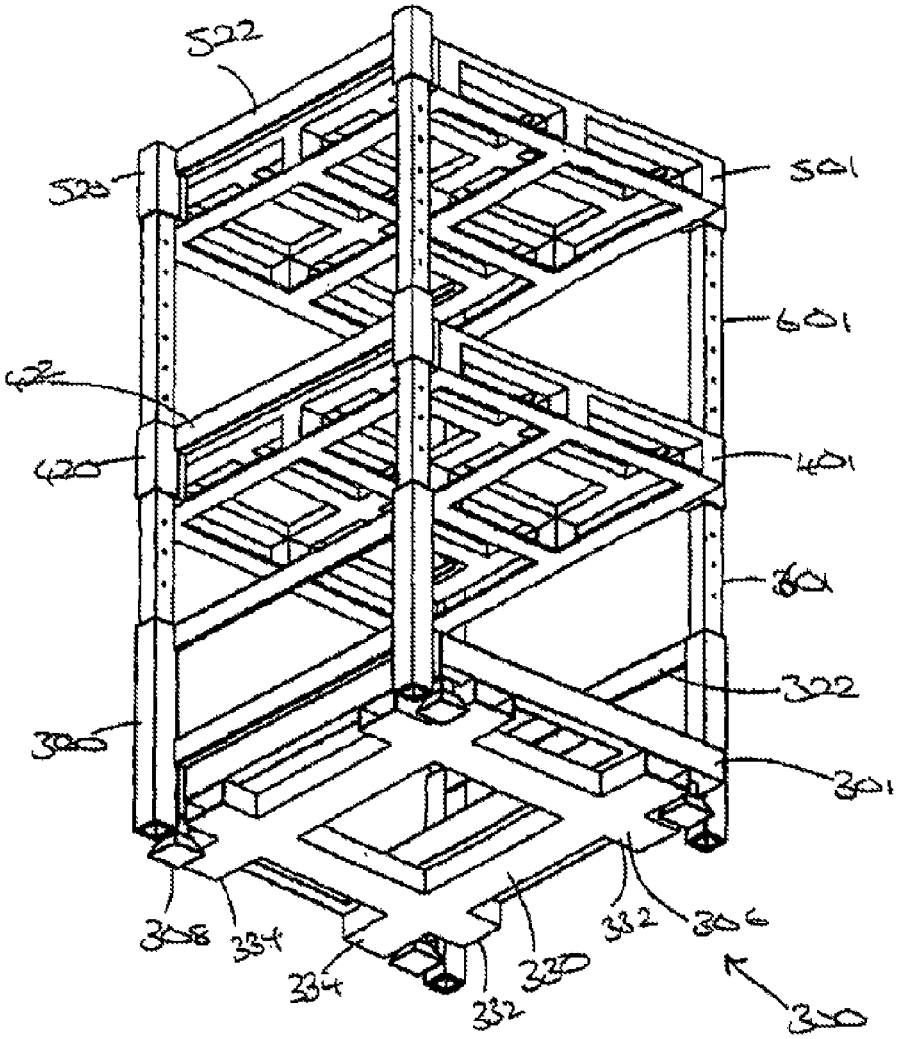
FIG. 5 is a lower perspective view of the stack of pallets of FIG. 4.
Figure 6:
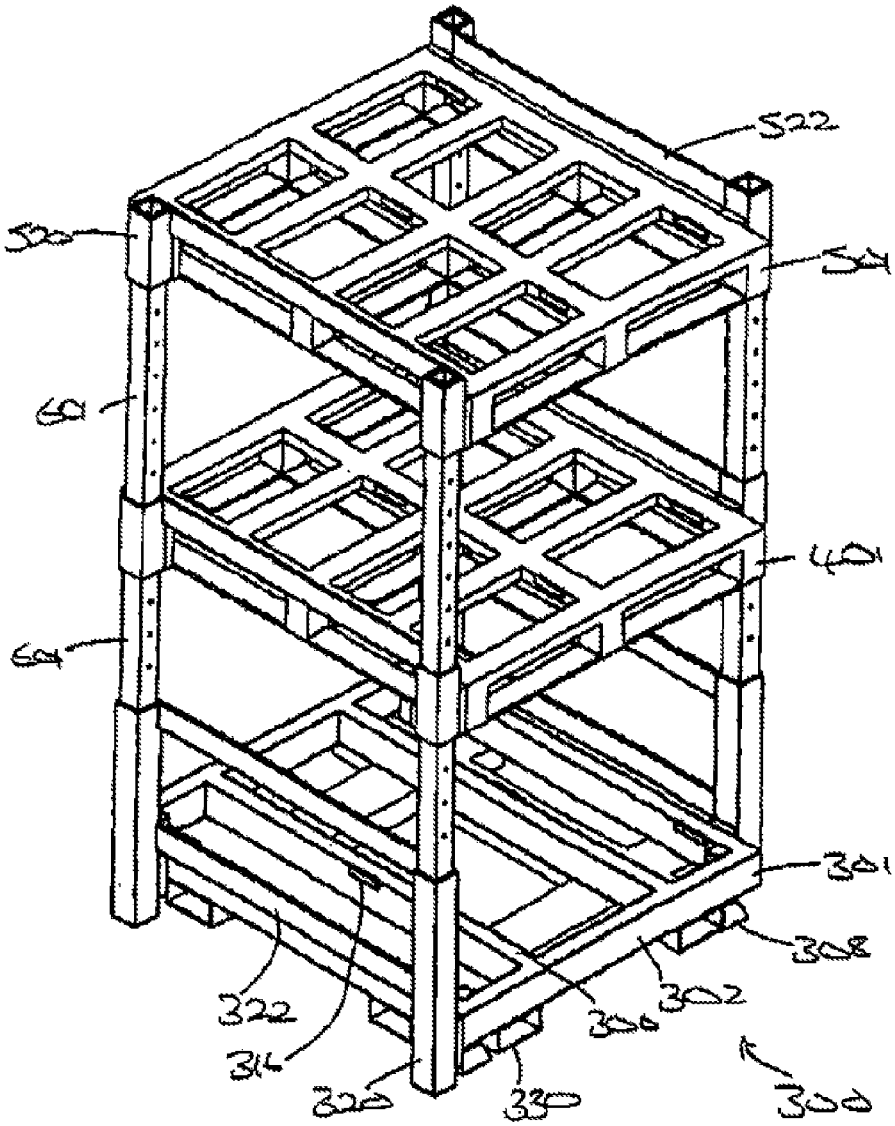
FIG. 6 is an upper perspective view of the stack of pallets of FIG. 4.
Figure 7:
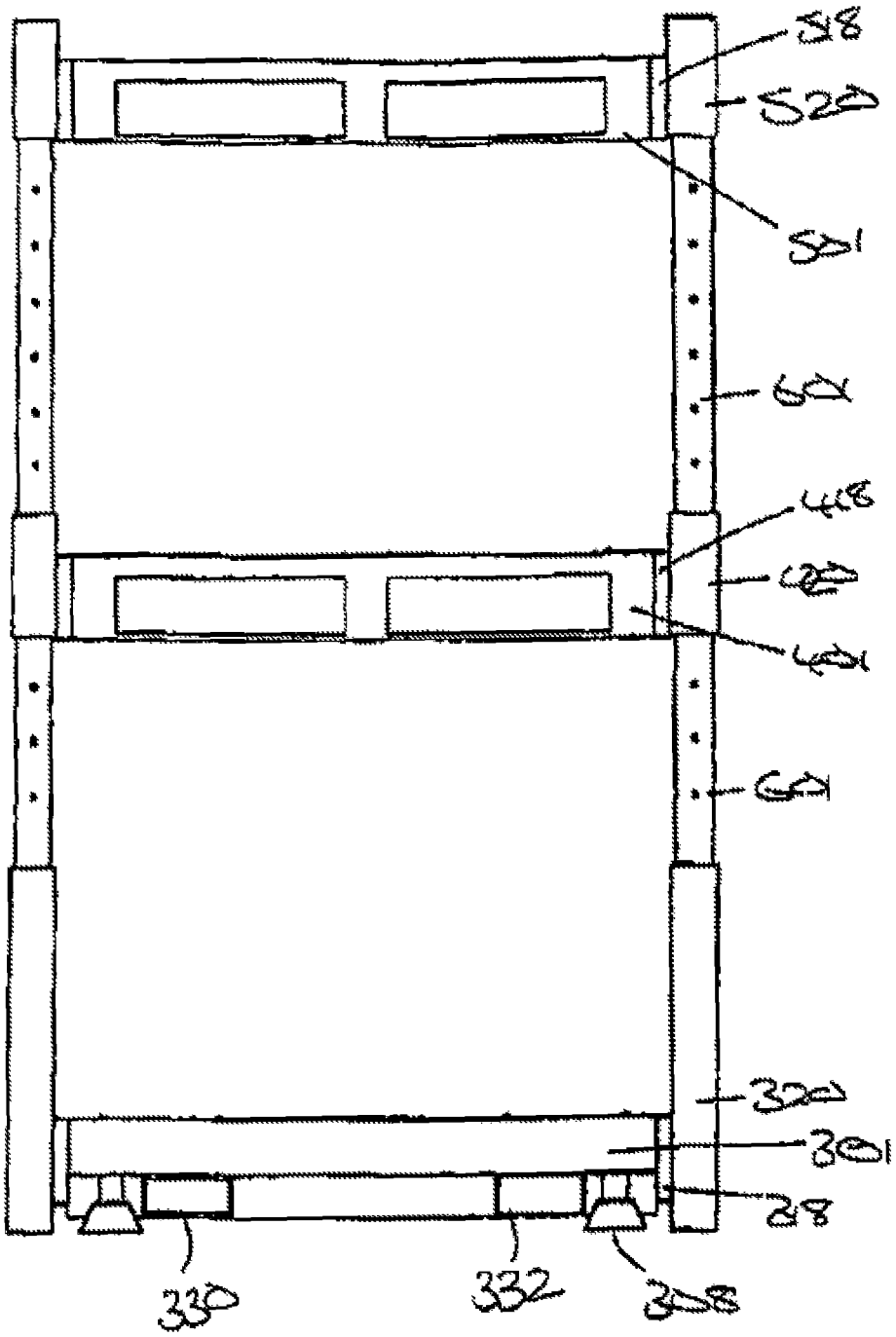
FIG. 7 is a side view of the stack of pallets of FIG. 4.

Referring now to FIG. 3, the pallets 1, 101 thereshown have been loaded with goods, 40, 140. Due to the legs on the outside of the chassis and the leg extension posts, a stable structure is provided. The goods are themselves loaded onto standard wooden pallets 42, 142, although this is not necessary and will not always be the case. Guides 44, 144, are provided on the legs 20, 120 to assist with the loading of the wooden pallets, correctly positioning them on the pallet 1. Generally, heavier goods will be stacked on the lower pallet, and lighter goods, and usually fewer goods will be provided on the upper pallet.

A second embodiment of the invention is shown in FIGS. 4 to 7. The stack 300 thereshown comprises three pallets 301, 401, 501. The lowermost pallet 301, is similar to the pallet 1 of the first embodiment. It includes a chassis having a frame 304, of box-section construction with additional strengthening cross-members, 306 also of box-section construction. The pallet 301 also include feet 308, extending below the chassis to leave a fork lift gap for movement thereof. Positioned between the cross-members are holding trays 310, provided with a grill base. Straps (not shown) are provided for securing goods, possibly provided on a standard wooden pallet (not shown), to the chassis. Gripper rods 316 are also provided at various positions to enhance the grip between the chassis and the wooden pallet onto which the goods are loaded. This chassis will typically be made of steel for strength, although it could also be made of aluminium or any other strong material.

The lowermost pallet 301 is also provided with fork-lift-blade guides 330. These are provided in pairs 332, 334 on each side of the chassis aiding lifting of the pallets by a fork lift truck.

Separated from the chassis by spacers 318, are positioned legs 320. These are positioned adjacent each corner of the chassis for maximum support. The legs are provided in pairs, with cross-members 322 between each pair. The legs 320 are of hollow box-section lengths and act as sleeves for the leg extensions 601. Importantly, the legs are off-set from each other on opposite sides, enabling interlocking of the legs, thus saving space, but also stabilising the pallets together.

While the upper pallets 401 and 501 could be of identical construction to the lower pallet, in this embodiment, they are shown having a different, lighter construction. These pallets 401, 501 comprise a chassis made of pressed aluminium sheeting forming and open box structure. The open box structure provides spaces for fork lift truck blades. However, any design could be used. This provides a lighter chassis for upper layers of the stack, thus reducing the overall weight of the stack, decreasing its transport costs, and enabling the lower chassis to bear the weight of more layers in a stack.

Separated from the chassis by spacers 418, 518, are legs 420, 520. These legs 420, 520 are typically provided of steel box-section but may be of aluminium box-section or any other material. As with the lowermost chassis 301, the legs are provided adjacent the corners of the chassis and are provide in pairs with each pair being provided with a cross-member 422, 522.

The stack also include spacers, 601, which connect legs 320, 420 on lower chassis, to legs 420 520 on upper pallets, enabling the distance between the pallets to be adapted to suit to goods to be held on the chassis.

Referring now to FIGS. 8 and 9, the chassis thereshow is an alternative chassis for use in a stack such as shown in FIGS. 1, 3, 4, 5, 6, & 7.

The pallet thereshown 901 comprises a chassis 902 having framework 904 of box steel. The framework comprises edge sections 905, corner sections 907, and cross members 906. Feet 908 are provided as extensions to ground level of the corner sections 907, leaving a fork lift gap beneath the chassis.

Fork lift guides 930 are provided under each side of the chassis. These comprise short box-sections sized and space to receive the blades of a fork lift truck, to ensure that the chassis is correctly balanced on the fork for lifting.

In this embodiment neither holding trays, nor straps are provided within the chassis to reduce the weight of the chassis, however, they could be incorporated into the chassis. Gripper 916 rods are however, provided to increase the friction connection between the chassis and goods, including palletised goods, loaded thereon.

As in the previous embodiments, the chassis 902 is provided with legs 920 separated from the chassis by spacers 918. The spacers simply act to connect the legs to the chassis, may comprise the weld between the two. The legs are provided in pairs adjacent opposite corners of the chassis, having a cross-member 922 therebetween. These cross-members act to strengthen the legs and also act as guides for goods placed on the chassis. The legs comprise hollow box section sections, into which extension posts, as described in the first embodiment (24) can be inserted, allowing for the stacking of a further chassis.

As described in relation to the other embodiments, preferably the pairs of legs are staggered with respect to one another to allow for closer packing of the pallets. On one side of the pallet, the first leg, 920(1) will be adjacent its corresponding corner post while its pair 920(2) will be inset from its corner post by just over the width of the leg. On the other side, the front leg 920(3) will be off-set from the corner post by just over the width of a leg, while the back leg 920(4) will be adjacent its corner post.

The pallet of this embodiment will generally be used as a bottom pallet in a stack. When used in this manner this pallet will generally be made of steel to provide the necessary strength for supporting goods thereon, together with upper pallet(s) and their goods. Upper pallets in the stack will generally be of a lighter constructions, for example those described in the second embodiment, or made as described in this embodiment or the first embodiment, by made of a lighter material, typically aluminium or plastics material, including reinforced plastics.

Referring to FIGS. 10 and 11 of the drawings, the transport pallet system there shown, comprises a chassis 1000, having an outer perimeter defining within it a pallet sized load-bearing platform for a pallet. The chassis comprises a framework constructed of box steel.

The chassis 1000 comprises an outer frame 1001, provided with additional strengthening cross members 1002. Positioned perpendicular to the cross members 1002 are additional strengthening cross members 1013, via which the transport can be lifted on lift forks. Any number of cross-members 1002 may be provided and together the outer frame, 1001, and cross-members, 1002, provide a platform on which goods can be placed. The chassis is provided with feet, 1009, and legs, 1007, extending below the chassis to leave a fork lift gap to enable the pallet to be moved when required.

At least part of the chassis include grippers, 1003, to provide attachment points for securing goods on the chassis. This is an optional feature, but aids the storage of goods by providing additional friction.

Separated from the chassis by spacers 1005, are positioned legs 1007. These are positioned adjacent on each corner of the chassis for maximum support. As shown, the legs are provided in pairs, with a strengthening cross-members, 1006, provided between each pair. These stabilise the pairs of legs. The legs are provided as hollow box-section lengths. As shown the cross-members, 1006, are also provided as hollow box-section lengths, although these could also be provided as flat bars. The legs extend below the chassis to the same extent at the chassis feet, resulting in a stable support for the chassis. As shown four legs are provided in two pairs. However, four pairs of legs could also be provided.

Referring to FIG. 11, the feet, 1009, are provided with bottom plates, 1014, that aim to spread the weight of the chassis and its contents. In a similar way, the legs, 1007, are also provided with bottom plates, 1010, to spread the weight of the chassis and its contents, but also to prevent the leg extensions, 1008, from extending through the legs, 1007.

Referring back to FIG. 10, the leg extensions 1008, are positioned inside the legs 1007. The leg extensions, 1008, are provided with a series of apertures, 1011, into which nose pins can be positions to prevent a second chassis from sliding fully down the posts. This enables the distance between the first and a second chassis to be set to any desired distance. The leg extensions, 1008, are also provided with a pointed guide, 1012, to enable ease of positioning of a second chassis on to the leg extensions, 1008.

The transport chassis of FIGS. 10 and 11 can be fitted with a second chassis shown in FIGS. 12 to 15. It includes a chassis, 2000, FIG. 12, having a frame 2001, of angle-section construction with additional strengthening cross-members, 3001, FIG. 13, also of strip-section construction.

The chassis, 2000, also include feet, 2003, 2004, extending below the chassis to leave a fort lift gap for movement thereof. Feet 2004 are angled inwards. Positioned at the base of the feet is an interconnecting strip 2002, to provide additional strength. Supported by spacers, 2005, are sockets 2007, which are provided at the outside the perimeter of the chassis 2000. A semi-circular cut-out, 2006, is provided for nose pins 4001, FIGS. 14 and 15, which are used to prevent a chassis from sliding down the leg extension posts 1008. Sockets 2007 are open ended for receiving the leg extension posts 1008 and are highlighted in FIGS. 14 and 15 whereby a second chassis 2000 is position on leg extension posts 1008. The figure also illustrates that the transport pallet can be provided with a third chassis, the same as or similar to chassis 2000 with its legs/sockets receiving the leg extension posts.

Another embodiment is shown in FIGS. 16 and 17. It includes a chassis 5000, having a frame 5001, of box-section construction with additional strengthening cross-members 5002 also of box-section construction.

Supported by spacers, 5004, are sockets 5006, which are provided at opposite ends of chassis 5000. A semi-circular cut-out, 5007, is provided for nose pins 4001, which are used to prevent a chassis from sliding down leg extension posts 1008. Sockets 5006 are open ended for receiving the leg extension posts 1008.

At least part of the chassis include grippers, 5003, to provide attachment points for securing goods on the chassis. FIG. 17 illustrates a pair of chassis 5000 which are positioned on the leg extension posts 1008. FIG. 17 also illustrates that the transport pallet can be provided with a third chassis, the same as or similar to the chassis 5000 with its legs/sockets receiving the leg extension posts.

A plate, not shown, can be provided to bridge between the two chassises 5000. It can have pegs engageable in sockets in the chassises for its location on them.

The invention is not intended to be restricted to the details of the above-described embodiments. For instance, the chassis can be provided with compartments in their interior for storing the leg extension posts when not in use. More than three chassis can be stacked on top of each other, particularly where the goods are relatively low and cannot have other goods stacked directly onto them.

The invention claimed is:

1. A transport pallet comprising:

a first chassis having:

an outer perimeter defining within it a pallet-sized load bearing platform for a pallet and a plurality of feet extending below the first chassis for supporting the first chassis on the ground with a lifting fork space beneath the first chassis, wherein at least a portion of said plurality of feet are within the outer perimeter of the first chassis; and a plurality of legs attached to the first chassis outside the outer perimeter of the chassis and the pallet;

the plurality of legs having upper portions above the first chassis and being provided in pairs at two respective opposite sides of the pallet sized load bearing platform; and a corresponding plurality of leg extension posts above the upper portions of the plurality of legs;

a second chassis having:

an outer perimeter defining within it a pallet-sized load bearing platform for a pallet;

a plurality of feet extending below the second chassis with a lifting fork space beneath the chassis, wherein at least a portion of said plurality of feet are within the outer perimeter of the second chassis; and a plurality of sockets provided outside the perimeter of the chassis and attached thereto, the sockets being open ended for receiving the leg extension posts, wherein the perimeter is defined by a rectangular frame and the plurality of feet are angled inwards extending below the rectangular frame.

2. A transport pallet according to claim 1, wherein the plurality of legs each have hollow upper portions and wherein the leg extension posts are sized to fit into the hollow upper portions of the plurality of legs.

3. A transport pallet according to claim 1, wherein the feet and the legs have closed lower ends for spreading load on the ground.

4. A transport pallet according to claim 1, further comprising a deck surrounding the rectangular frame.

5. A transport pallet according to claim 1, further comprising;

a pair of frames having:

a pair of sockets provided at opposite ends of the frames, the sockets being open ended for receiving the plurality of leg extension posts.

6. A transport pallet according to claim 5, also including a pallet sized deck, the frames and the pallet sized deck having complementary formations for support of the pallet sized deck on the frames above the first chassis.

7. A transport pallet according to claim 5, wherein the frames have upwardly projecting serrations.

8. A transport pallet as claimed in claim 1, wherein the plurality of leg extension posts include means for adjusting the distance between the first chassis and the second chassis.

9. A transport pallet according to claim 1, wherein the upper portions of the plurality of legs are provided with at least one cross member provided between a pair of the plurality of legs at respective sides of the first chassis.

10. A transport pallet according to claim 1, wherein the chassis is provided with teeth to increase friction and assist in holding goods securely on the pallet.

11. A transport pallet according to claim 1, wherein the pallet further includes straps for securing the goods to the pallet.

12. A transport pallet according to claim 1, wherein at least part of the chassis includes a grill to provide attachment points for securing goods on the chassis.

13. A transport pallet comprising:

a first chassis having:

an outer perimeter defining within it a pallet-sized load bearing platform for a pallet and a plurality of feet extending below the first chassis for supporting the first chassis on the ground with a lifting fork space beneath the first chassis, wherein at least a portion of said plurality of feet are within the outer perimeter of the first chassis; and a plurality of legs attached to the first chassis outside the outer perimeter of the chassis and the pallet, wherein the plurality of legs have upper portions above the first chassis and being provided in pairs at two respective opposite sides of the pallet sized load bearing platform; and a corresponding plurality of leg extension posts above the upper portions of the plurality of legs;

a pair of frames having:

a pair of sockets provided at opposite ends of the frames, the sockets being open ended for receiving the plurality of leg extension posts, wherein the frames have upwardly projecting serrations.

* * * * *